US011674303B2

(12) United States Patent
Goldwitz

(10) Patent No.: US 11,674,303 B2
(45) Date of Patent: Jun. 13, 2023

(54) FRAMING DEVICE

(71) Applicant: Brian Goldwitz, Waterbury, CT (US)

(72) Inventor: Brian Goldwitz, Waterbury, CT (US)

( * ) Notice: Subject to any disclaimer, the term of this patent is extended or adjusted under 35 U.S.C. 154(b) by 0 days.

(21) Appl. No.: 17/010,807

(22) Filed: Sep. 2, 2020

(65) Prior Publication Data

US 2022/0064936 A1 Mar. 3, 2022

(51) Int. Cl.

| | |
|---|---|
| ***E04B 1/41*** | (2006.01) |
| ***E04B 7/02*** | (2006.01) |
| ***E04B 2/70*** | (2006.01) |
| ***E04B 1/38*** | (2006.01) |

(52) U.S. Cl.

CPC ..... *E04B 1/40* (2013.01); *E04B 2/70* (2013.01); *E04B 7/022* (2013.01); *E04B 2001/405* (2013.01)

(58) Field of Classification Search

CPC ... E04B 1/40; E04B 2/70; E04B 7/022; E04B 2001/405; E04B 1/2604; E04B 2001/2644; E04B 2001/266; E04B 2001/262; E04B 1/2608

See application file for complete search history.

(56) References Cited

U.S. PATENT DOCUMENTS 2,365,501 A * 12/1944 Walstrom ..... E04G 7/12 403/174
3,184,800 A * 5/1965 Nelson ..... E04B 1/2608 403/219
3,414,300 A * 12/1968 Spane ..... E04C 3/42 403/300
3,425,720 A * 2/1969 Spane ..... E04B 1/2604 403/247
3,481,635 A * 12/1969 Tracy ..... E04B 7/06 403/3
3,596,941 A * 8/1971 Tracy ..... E04B 1/2608 403/27
3,965,640 A * 6/1976 Andersson ..... E04B 1/2604 52/704
4,498,801 A * 2/1985 Gilb ..... F16B 9/058 403/232.1
4,560,301 A * 12/1985 Gilb ..... B21D 53/38 403/232.1
5,524,397 A * 6/1996 Byers ..... E04C 3/42 52/92.2
9,809,974 B1 * 11/2017 Brekke ..... E04B 1/003
10,227,770 B2 * 3/2019 Delfeld ..... E04B 2/562
11,118,349 B2 * 9/2021 Montoya ..... E04B 1/40
2014/0130442 A1 * 5/2014 Fuller ..... E04B 7/022 52/696
2018/0148920 A1 * 5/2018 Delfeld ..... E04B 1/2608
2021/0230870 A1 * 7/2021 Montoya ..... E04B 1/40

* cited by examiner

*Primary Examiner* — Rodney Mintz
(74) *Attorney, Agent, or Firm* — Jeffrey M. Furr; Furr Law Firm

(57) ABSTRACT

A simplified framing system with two or more arches which are joined together into a unitary structure by means of connector elements. Each arch is joined to a base by means of connector elements herein termed "base frame connectors". The angle frame connectors and base frame connectors are preferably fabricated from sheet metal by conventional die cutting and press-forming or stamping techniques. The simplified framing system of this disclosure is particularly designed for assembly using nominal 2×4 inch lumber. The system does not require cutting the lumber except for straight, perpendicular cutting of the lumber to the desired lengths.

4 Claims, 10 Drawing Sheets

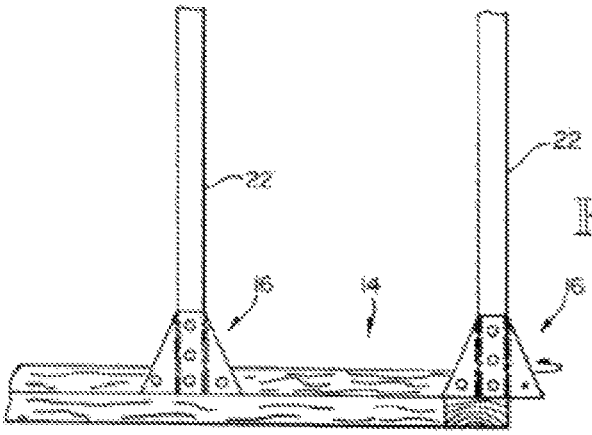
FIG.3
FIG.4
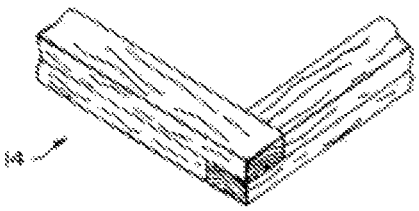

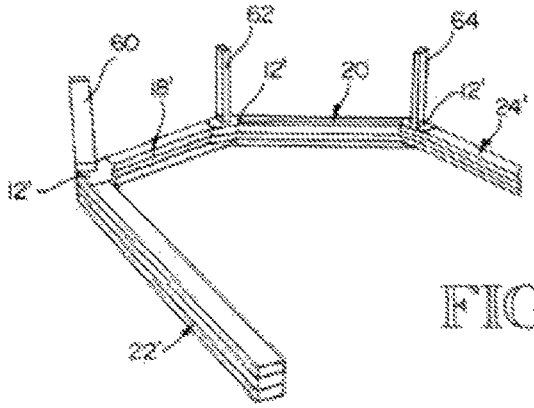
FIG. 12
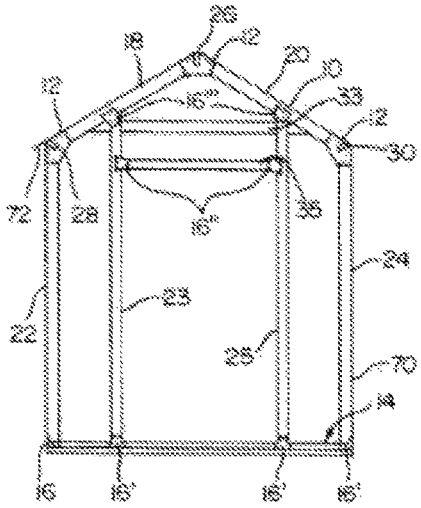
FIG. 13
FIG. 14
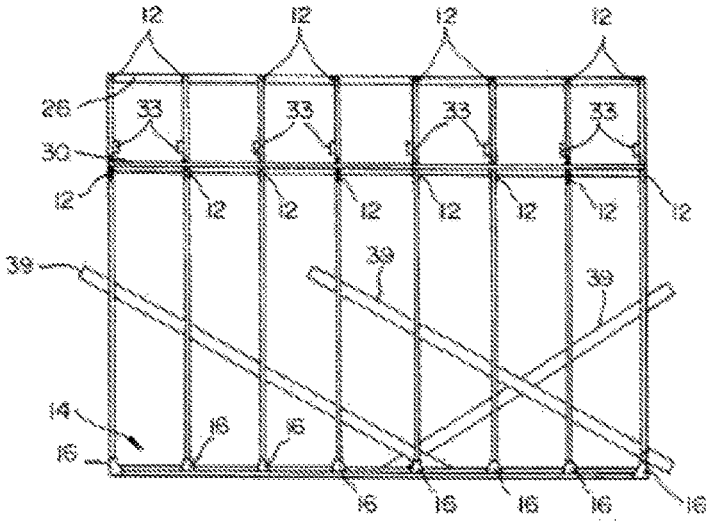

FRAMING DEVICE

TECHNICAL FIELD

The technology discussed below relates generally to framing systems for use in constructing wood frame buildings, and more particularly to sheet metal connectors used to join wood framing members together which have a lip.

BACKGROUND

Many efforts and devices have been provided to make it easier to assemble a wood-framed building. In particular, efforts have been made to provide systems and devices for use by unskilled workman that can be used to assemble a structurally-sound building frame without the knowledge and skill of a skilled craftsman. These efforts have included the provision of metal connectors or brackets designed to be used to connect, by way of example, rafters to ridge beams, rafters to wall studs, posts or wall studs to bases, and posts or wall studs to sill plates. Such metal connectors or brackets, however, have often been relatively expensive or have been cumbersome to use, to such an extent that they are not usually employed for building simple frame structures of the kind contemplated by the present invention.

SUMMARY

The simplified framing system of this disclosure provides two or more arches which are joined together into a unitary structure by means of connector elements. Each arch is joined to a base by means of connector elements herein termed "base frame connectors". The angle frame connectors and base frame connectors are preferably fabricated from sheet metal by conventional die cutting and press-forming or stamping techniques. The simplified framing system of this disclosure is particularly designed for assembly using nominal 2×4 inch lumber. The system does not require cutting the lumber except for straight, perpendicular cutting of the lumber to the desired lengths.

Consequently, the assembly of this frame system is well within the skill of an ordinary home craftsman; no skilled technique is required. A pair of top angle frame connectors join two roof rib boards. A pair of left side angle frame connectors join left rib to a left side leg. A pair of right side angle frame connectors join right rib to a right side leg. Two or more such arches are secured in line to the base by their respective sets of left and right base frame connectors. The multiple arches are joined together by a top ridge board and by left and right edge boards.

DRAWINGS

FIG. 3 is a detail view in side elevation illustrating the assembly of two side legs to a base member by means of example base frame connectors according to at least one example of the present disclosure.

FIG. 4 is a detail view in perspective illustrating a base member end assembly according to at least one example of the present disclosure.

Figure 5A:
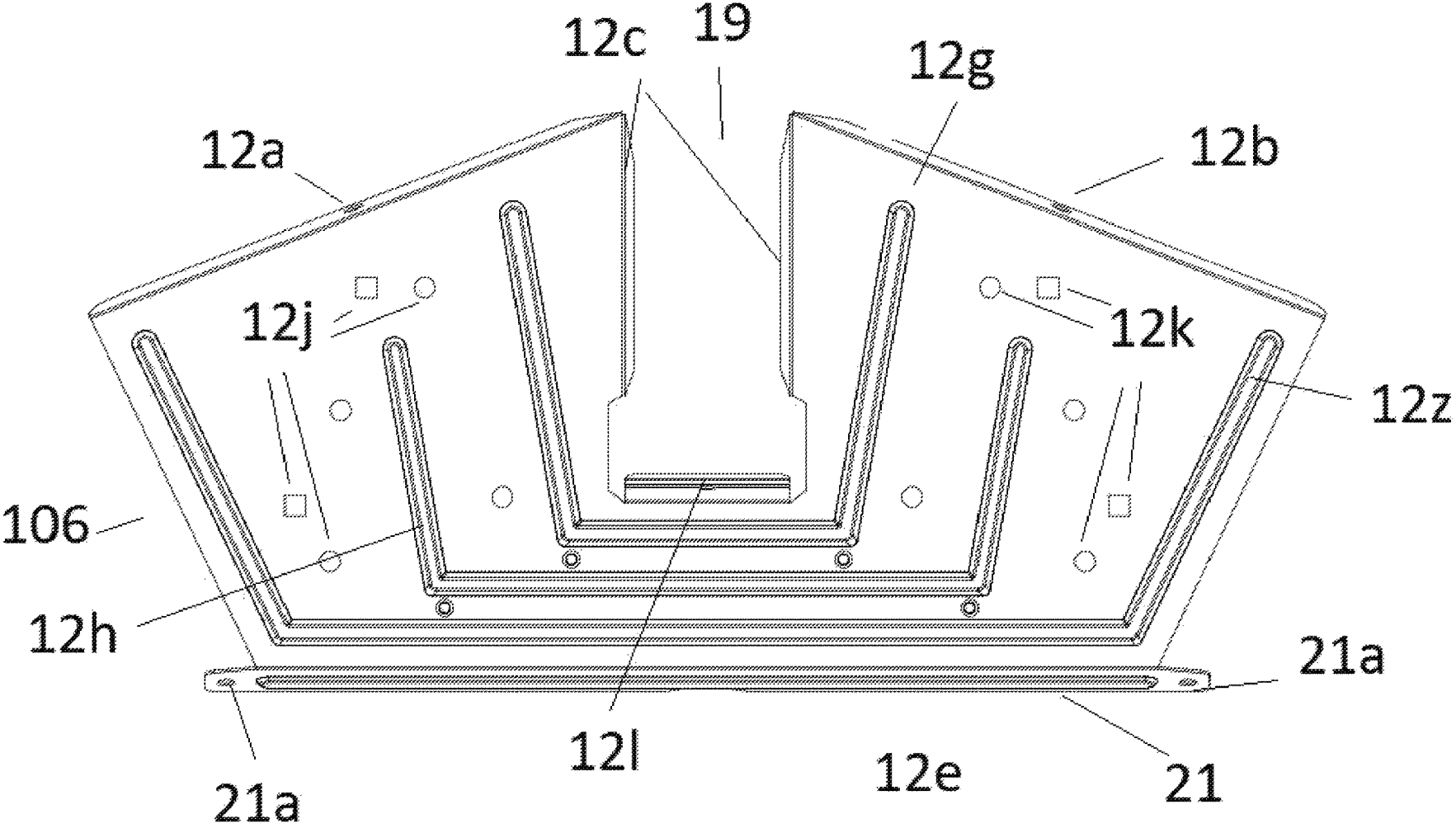

FIG. 5*a* is a plan view of the angle frame connector according to at least one example of the present disclosure.

Figure 5B:
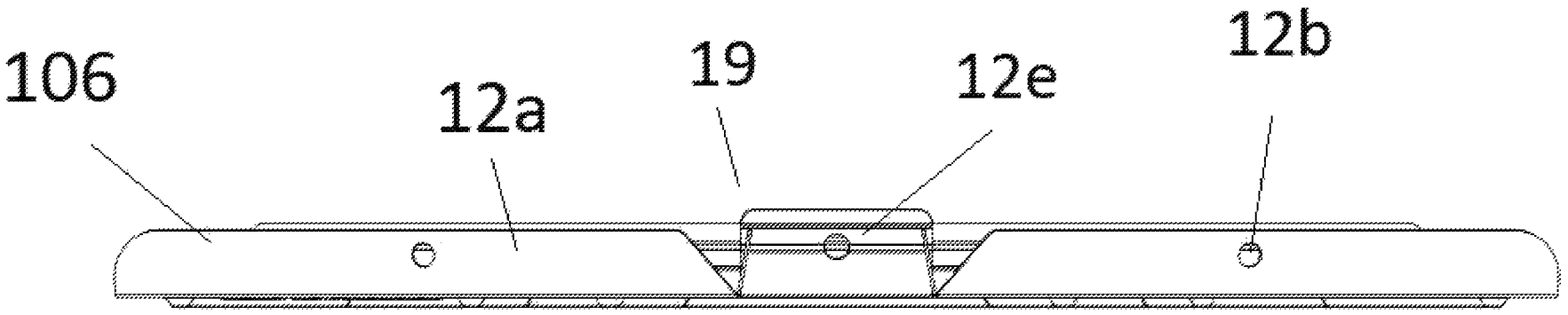

FIG. 5*b* is a bottom view of the angle frame connector according to at least one example of the present disclosure.

Figure 5C:
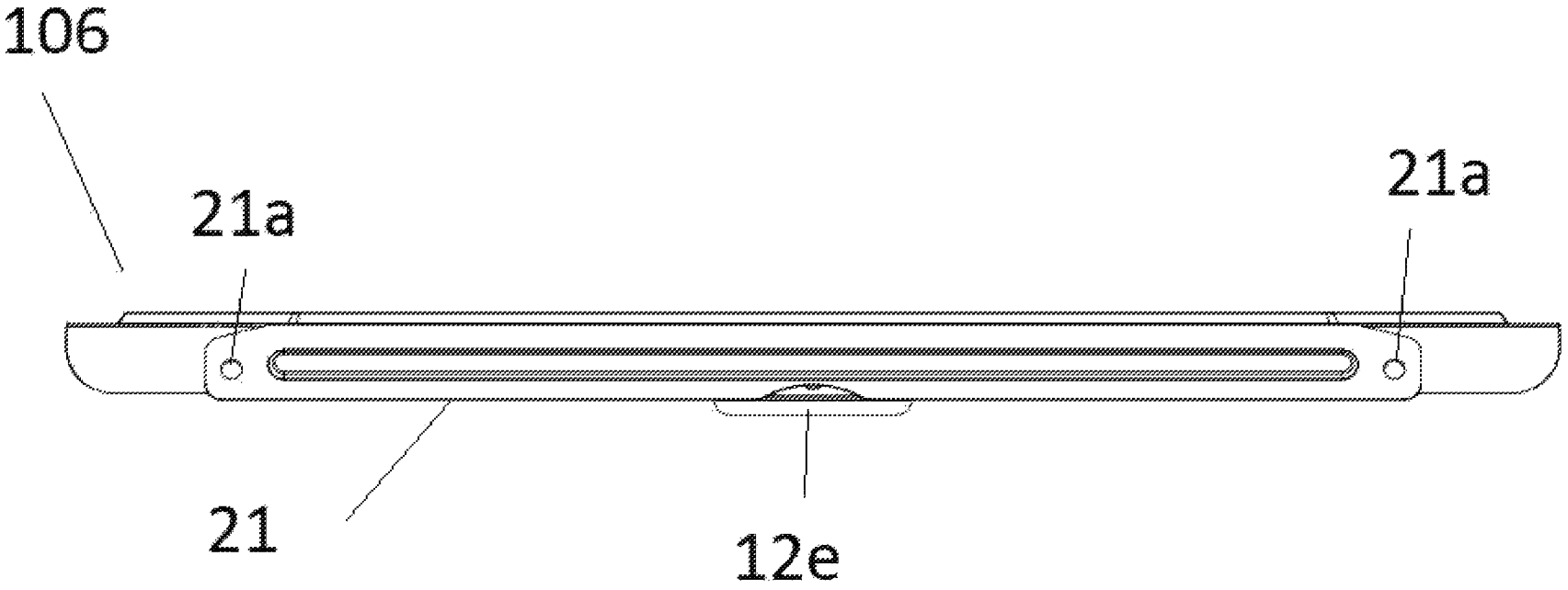

FIG. 5*c* is a top view of the angle frame connector according to at least one example of the present disclosure.

Figure 6:
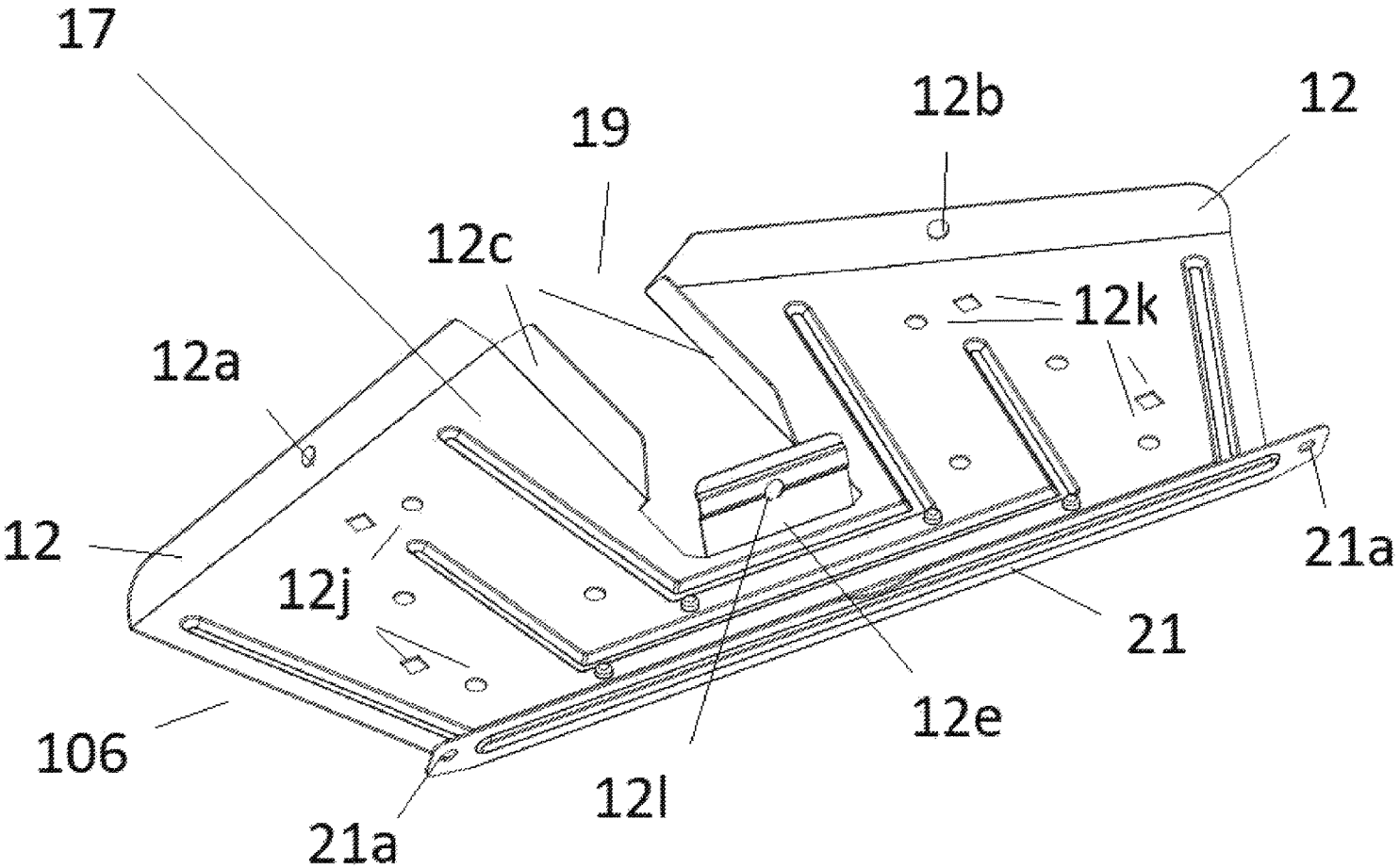

FIG. 6 is a view in perspective of an angle frame connector illustrating its inside configuration according to at least one example of the present disclosure.

Figure 7:
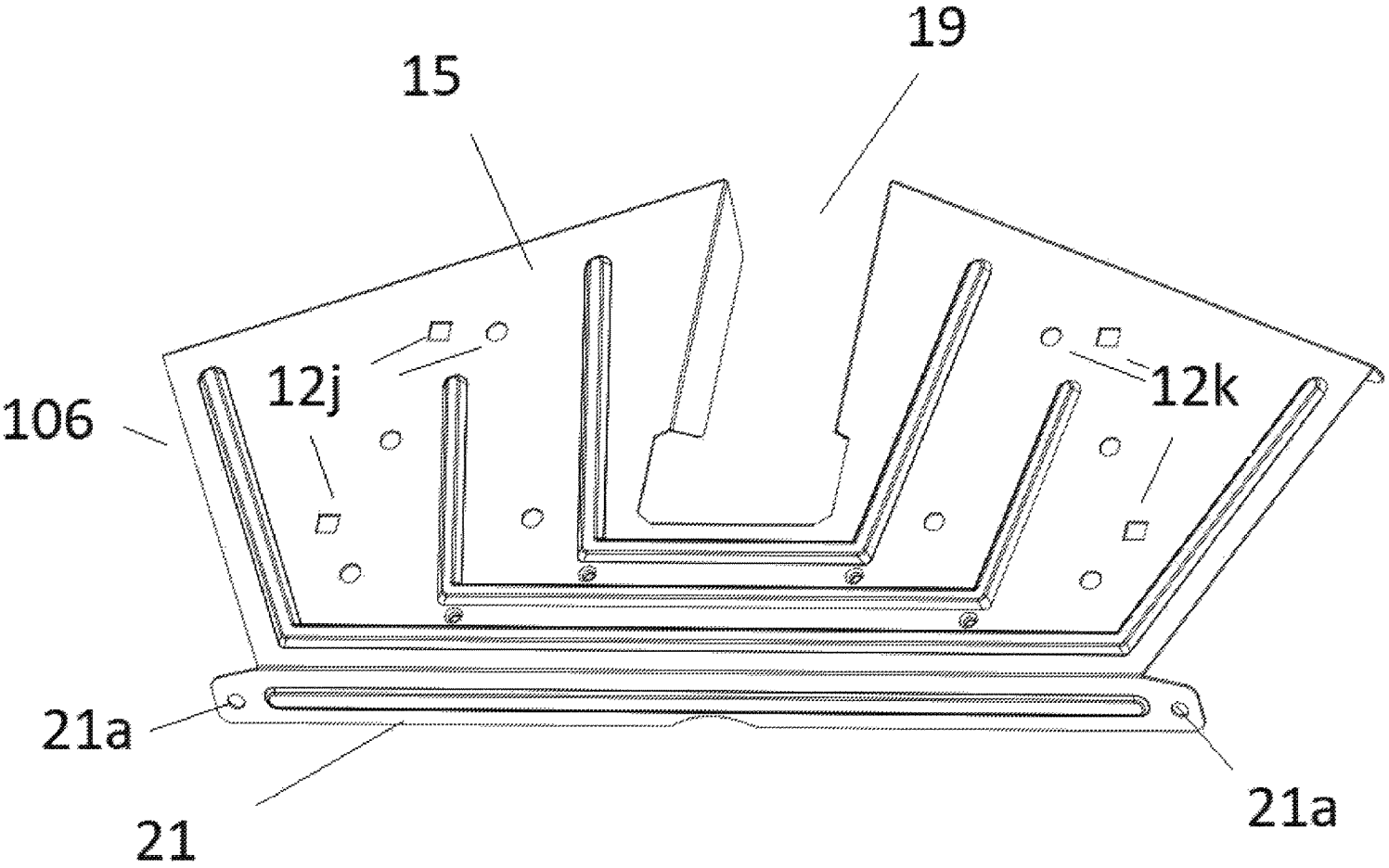

FIG. 7 is a view in perspective of an angle frame connector illustrating its outside configuration according to at least one example of the present disclosure.

Figure 8A:
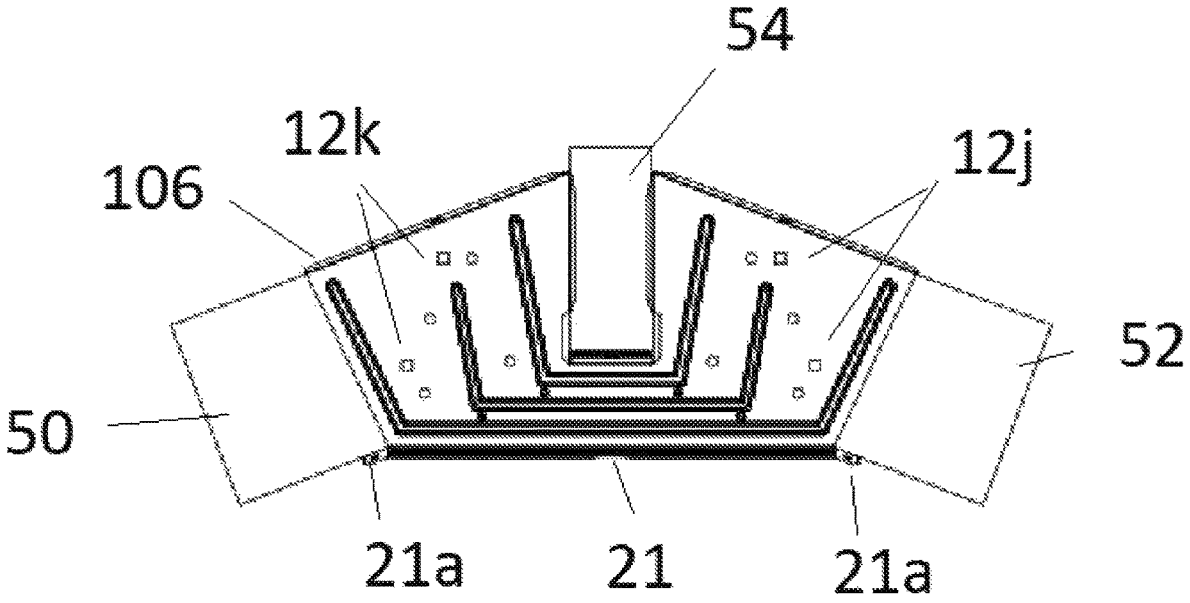

FIG. 8*a* is a plan side view of an angle frame connector illustrating the assembly of two rafters and a ridge beam according to at least one example of the present disclosure.

Figure 8B:
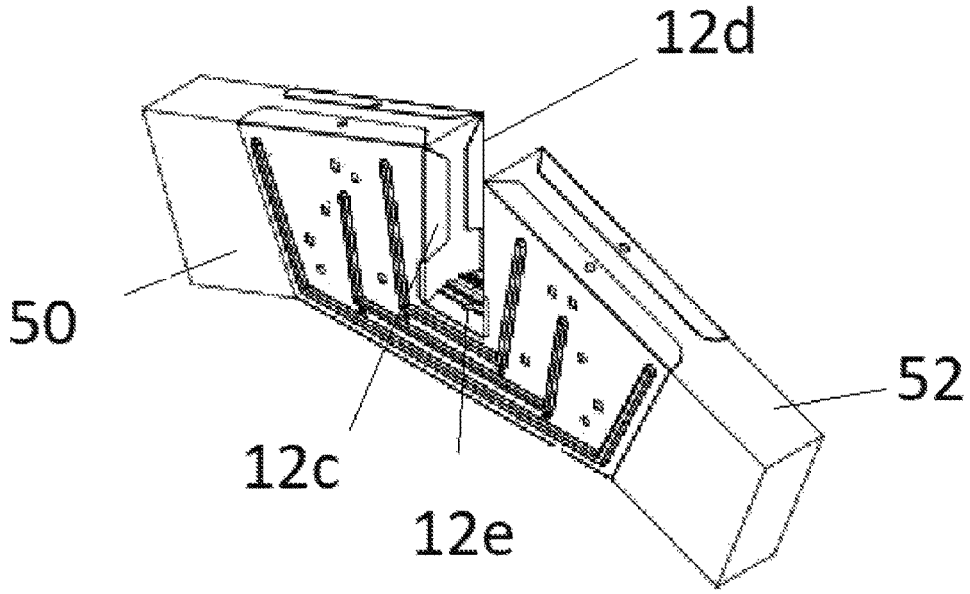

FIG. 8*b* is a plan elevated view of an angle frame connector illustrating the assembly of two rafters and a ridge beam according to at least one example of the present disclosure.

Figure 9:
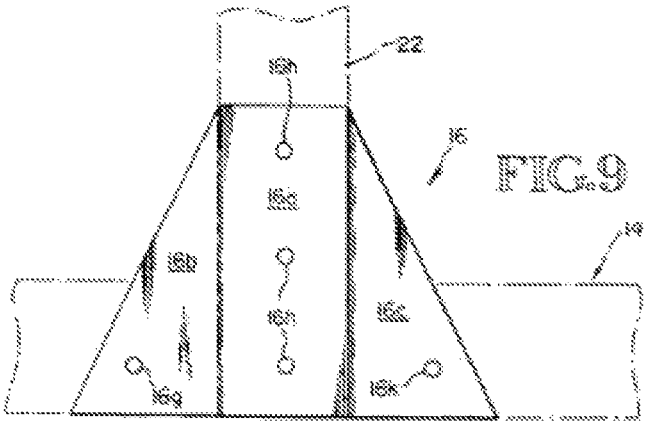

FIG. 9 is a plan view of a base frame connector illustrating in dotted line the assembly of an arch side leg and a base member according to at least one example of the present disclosure.

Figure 10:
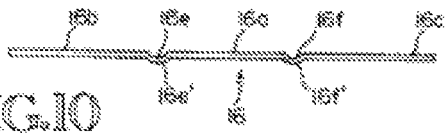

FIG. 10 is a bottom edge view of the FIG. 9 base frame connector.

Figure 11:
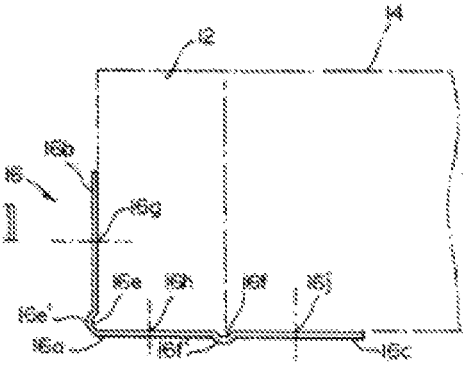

FIG. 11 is a top edge view of a base frame connector according to at least one example of the present disclosure used to assemble an end arch side leg to a base member.

FIG. 12 is a perspective view illustrating an assembly technique for ensuring the uniformity of a plurality of arches constructed with angle frame connectors.

FIG. 13 is an end elevation view of a framework assembled with angle frame connectors and base frame connectors according to at least one example of the present disclosure.

FIG. 14 is a side elevation view of the FIG. 13 framework according to at least one example of the present disclosure.

DETAILED DESCRIPTION

The illustrations presented herein are, in some instances, not actual views of any particular framing devices or components thereof, but may be idealized representations which are employed to describe the present disclosure. Additionally, elements common between figures may retain the same numerical designation.

Figure 1:
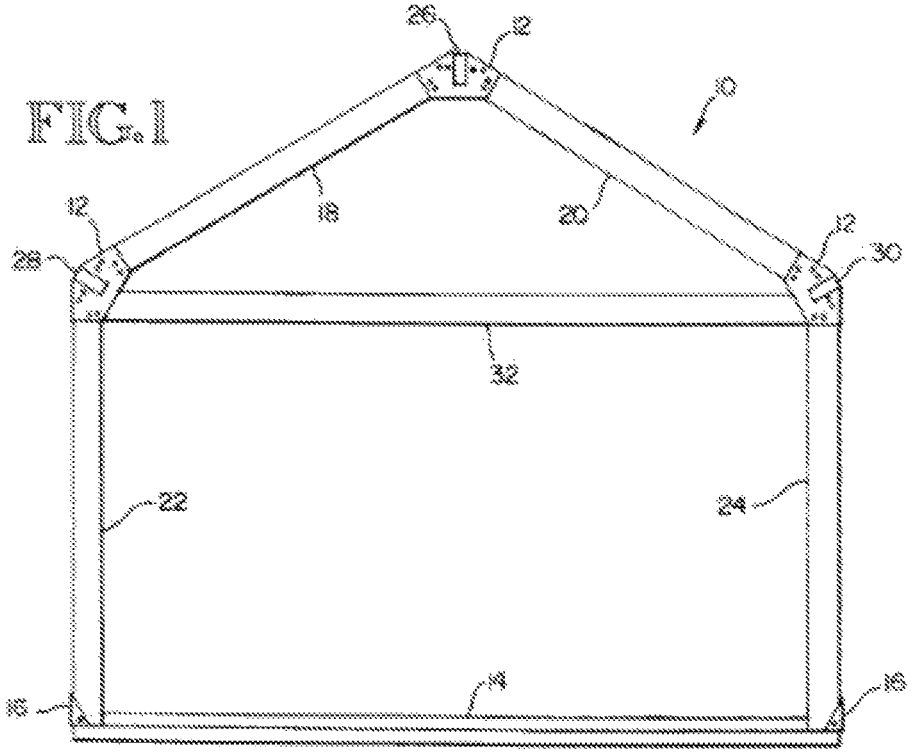
FIG. 1 is an end elevation view of an arch constructed in accordance with the principles of this disclosure employing angle frame connectors and base frame connectors according to at least one example of the present disclosure.

The simplified framing system of this disclosure provides two or more arches 10 depicted in FIG. 1 which are joined together into a unitary structure by means of connector elements herein termed "angle frame connectors" 12. Each arch 10 is joined to a base 14 by means of connector elements herein termed "base frame connectors" 16. The angle frame connectors 12 and base frame 16 connectors are preferably fabricated from sheet metal by conventional die cutting and press-forming or stamping techniques. The simplified framing system of this disclosure is particularly designed for assembly using nominal 2×4 inch lumber. The system does not require cutting the lumber except for straight, perpendicular cutting of the lumber to the desired lengths. Consequently, the assembly of this frame system is well within the skill of an ordinary home craftsman; no skilled technique is required. A pair of top angle frame connectors 12 join two roof rib boards 18, 20. A pair of left side angle frame connectors 12 join left rib 18 to a left side leg 22. A pair of right side angle frame connectors 12 join right rib 20 to a right side leg 24. Two or more such arches 10 are secured in line to the base 14 by their respective sets of left and right base frame connectors 16. The multiple arches 10 are joined together by a top ridge board 26 and by left and right edge boards 28, 30.

The ridge and edge boards 26, 28, 30 would extend the entire length of the structure that is composed of the multiple arches 10. The width and height of the structure would depend on the length of the rib boards 18, 20 and the length of the legs 22, 24, respectively. In order to provide for a door frame at one end of the structure, an overhead horizontal brace board 32 could be located to provide a top mounting of the vertical side members of the door frame. Depending on the height of the desired doorway, the brace board 32 could be secured to the end arch side legs or to the end arch rib boards, the former being shown in FIG. 1.

Figure 2:
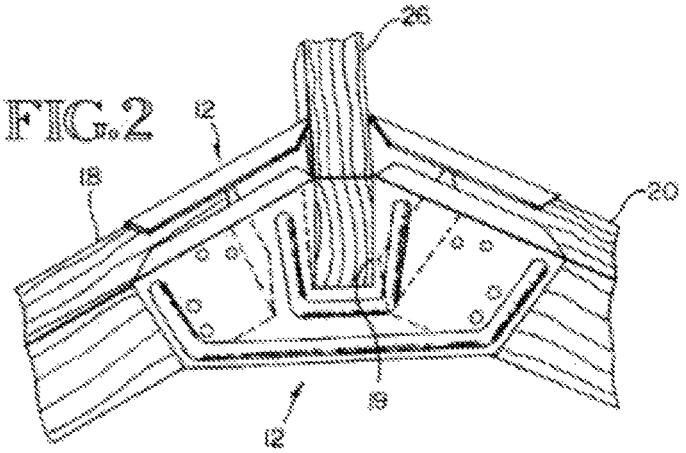
FIG. 2 is a detail view in perspective illustrating the assembly of two rafters and a ridge beam by means of embodiments of angle frame connectors according to at least one example of the present disclosure.

The angle frame connectors 12, FIGS. 2 and 5-8, are intended for use in pairs one on either side of the lumber segments that they join. This is shown in FIG. 2 with respect to joining two roof ribs 18, 20, but the same principle applies to joining a roof rib to a leg, 22 or 24. Referring to FIGS. 6 and 7, the angle frame connectors 12 have an outer face 15 and an inner face 17, the latter designed to be placed in contact with the lumber segments. The angle frame connectors are fabricated from sheet metal by die-cutting and press-forming operations. The sheet metal is first cut to provide a blank with an outline. With respect to FIGS. 5-8, the bent tabs of blank become, respectively, connector tabs 12*a*, 12*b*, 12*c*, 12*d* and 12*e*. During the forming operation, the blank can be fluted to provide elongated flutes on the inner surface and corresponding elongated beads in the outer surface. During the forming operation the forming die deforms the blank, thereby creating the flutes (i.e. elongated narrow depressions) in the inner surface 17, and these deformations result in beads (i.e. elongated narrow protrusions) that protrude from the outer surface 15. Blank is also punched to provide multiple nail/screw holes in the face of the blank and at the tab before the tabs are bent. These nail/screw holes in the blank are equivalent, in the finished connector of FIGS. 5-8, to nail/screw holes 12*j*, 12*k* and 12*l*.

Referring to FIGS. 8*a* and 8*b*, the perpendicular tabs 12*a*, 12*b* provide aligning surfaces for locating the ends of lumber segments 50, 52. As thus located, the tabs 12*a*, 12*b* overlay and contact the narrow edges of the lumber segments 50, 52. Lumber segments 50, 52 may then be fastened to the connector 12 by nails or screws applied through the nail/screw holes 12*k*, 12*l*. Because the intended preferred use of connectors 12 is in pairs, with one connector being located on either side of a lumber segment 50 or 52, the aligning tabs 12*a*, 12*b* must be less than one half the anticipated width of the lumber segment so that the opposing tabs of opposite connectors will not contact one another. In a typical and preferred construction, tabs 12*a*, 12*b* form an obtuse angle of about 120°. The tabs 12*a*, 12*b* are flat and long enough to provide an adequately-long aligning surface whereby a lumber segment 50 or 52 may be placed against the inner side of a tab and aligned parallel therewith.

Tabs 12*c*, 12*d* and 12*e* define the sides and bottom of a rectangular slot 19 for receiving a lumber cross segment 54. The slot 19 is configured to be only slightly larger than the anticipated width and depth of the lumber segment 54. In the preferred use of the connector 12, which is designed for use with nominal 2×4 lumber, the width and depth of the slot 19 would accommodate a 2×4 segment set on edge in the slot 19. As in the case of tabs 12*a*, 12*b*, tabs 12*c*, 12*d* and 12*e* must have a width slightly less than one half of the thickness of a 2×4 segment so that the tabs on the corresponding opposite connector will not contact one another. The connector may be fastened to the cross segment 54 by a nail or screw applied through the nail/screw hole 12*l*.

The connector will have a lip 21 that extends perpendicularly from the bottom of the inner surface 17. This lip 21 provides extra structural strength against torque forces and functions much better than existing prior art. The lip 21 will have lip tabs 21*b* that extend out slightly longer than the length of the bottom of the connector. The lip tabs 21*b* will be angled downward so they are flush with the lumber segments 50, 52 as shown in FIGS. 8*a* and 8*b*. Each lip tab 21*b* will have nail/screw holes 21*a*. The lip 21 will have a bead 21*b* (i.e. elongated narrow protrusions) that protrude from its surface. The lip 21 may be fasten to the cross segment 50 and 45 to provide further structural support by a nail or screw applied through the nail/screw holes 21*a*.

The angle frame connector 12, used in pairs to join two lumber segments such as two roof ribs or a roof rib and an arch leg, must provide a satisfactory degree of structural stability and strength inasmuch as the connector pair constitutes the sole joint between the adjacent ends of the lumber segments. To enable the connector to satisfactorily resist buckling and bending forces, the connector is provided with the beads 12*g*', 12*h*' and 12*z*'. The beads are somewhat U-shaped in that they each have a center straight section that extends between the two halves of the connector and an upturned section at the end of each straight section that extends transversely across the lumber segment-contacting portion of each connector half. Each upturned end section joins its straight center section at an obtuse angle. The straight sections are parallel to one another and centered below the lumber cross segment slot 19. The straight center section of the lower bead 12*z*' is significantly longer than the straight center section of the upper bead 12*g*', on the order of four times longer. The combination of the three beads 12*g*', 12*h*', 12*z*' satisfactorily minimizes the likelihood that the joint between the lumber segments 52, 54 could twist, bend or buckle across the connector 12.

The base frame connector 16, as shown in FIGS. 3 and 9-11, comprises an upstanding rectangular mid-section 16*a* flanked by two triangular-shaped end sections 16*b*, 16*c*. This connector 16 is fabricated from sheet metal by die-cutting and press-forming operations. The sheet metal is first cut to provide the outline shown in FIG. 9. The blank thus cut is then formed to provide two parallel flutes 16*e*, 16*f* on the inner surface of the connector, and corresponding beads 16*e*', 16*f* in the outer surface of the connector, as shown in FIG. 10. The blank is also punched to provide multiple nail/screw holes 16*g*, 16*k* and 16*h* in the face of the blank as shown in FIG. 9. The base frame connector flutes/bead define the vertical edges of the mid-section 16*a* and provide structural strength to the connector. In addition, the connector flutes/bead provide bend lines so that the end sections 16*b*, 16*c* can be bent perpendicular to the mid-section 16*c* as shown in FIG. 11. Where the connector 16 is to be used to anchor arch legs at the corners or ends of the structure, the normally-planar connector would be bent so that one of the bead/flutes would be located on the outer corner of the leg with the adjacent end section bent around to contact the end surface of the leg; this being shown in FIG. 11 with respect to bead/flute 16*e*'/16*e* and end section 16*b*. Where the connector 16 is to be used to anchor arch legs other than at the corners or ends of the structure, the connector is secured to the base 14 and the leg 22 in its planer configuration as shown in FIG. 9. FIG. 3 illustrates two connectors 16 securing two legs 22 to the base 14, the left connector securing a mid leg and the right connector securing a corner or end leg. For securing the end leg, the connector 16 would usually be fastened through its end section and mid-section to the base and leg, respectively, and then the other end section would be bent around its adjacent bead/flute and fastened to the perpendicular end of the base 14. The connector mid-section 16*a* is provided with a width equal to about the expected width of the leg 22 so that the vertical and parallel bead/flutes also provide guide lines for lining up the leg 22 in the middle of the connector. Consequently, each bead/flute will be located at the edge of the leg 22 as seen in FIGS. 9 and 11.

To erect the simplified frame system shown in FIGS. 1-4, the base frame 14 would be first installed. This base frame 14 can be made of two layers of 2×4 lumber laid on its face, with the base corners/ends overlapping in the manner shown in FIG. 4. Alternately, the base frame 14 could be made of 4×4 lumber with the corners/ends notched and overlapped to provide the FIG. 4 configuration. After assembling the base frame, the base frame connectors 16 would be installed using the lower line of three nail/screw holes shown in FIG. 9. The connectors would be installed so that the upper two nail/screw holes in the mid-section 16*a* would be exposed above the base frame for use in attaching the legs 22.

The roof arches may be assembled by laying out two roof rib boards 18, 20 and overlaying their adjacent ends with an angle frame connector 12. The ribs 18, 20 would be aligned with the connector tabs 12*a*, 12*b* and the connectors would be secured to ribs using the nail/screw holes 12*k*, 12*j*. It is preferable to use screws to secure the ribs to the connectors, rather than nails; and it is preferable to make all securements mentioned herein by using screws rather than nails. Fast threading screws of the type used in installing sheetrock have become commonly used to screw lumber products together because they require no pre-drilling prior to use. Then the roof arch, as thus far assembled, would be carefully turned over and the other connector 12 of the pair would be aligned and secured to the ribs 18, 20 to produce the configuration shown in FIG. 2. In aligning the second connector 12 of the pair, it would be convenient to insert a short piece of 2×4 lumber in the slot 19 of the previously installed connector 12 and then position the second connector so that its slot 19 lines up with the installed connector. When the arch is complete as thus far described, two people—one at each leg—could raise the arch upright and position it on the base frame 14 at the locations of two base frame connectors 16 on either side of the base frame. While holding the arch in a vertical position with the legs 18, 22 vertical and aligned with the mid-section 16*a* of each base frame connector 16, each person would secure a leg to the adjacent base frame connector, using the upper two nail/screw holes in the mid-section 16*a*. Then each leg 18, 20 could also be toe-nailed to the inside of the base frame. The corner/end base frame connectors 16 would be secured to the corners/ends of the base frame and, when the leg 22 or 18 was secured to that connector's mid-section 16*a*, the outer section 16*b* or 16*c* would be bent around the leg's outside corner and secured to the end of the base frame as shown in FIG. 11.

When all of the roof arches have been installed on the base frame 14, the edge and ridge boards 28, 30 and 26 can be installed. It is most convenient to install the edge boards 28, 30 before installing the ridge board 26. The edge boards are preferably installed by setting one end in the slot 19 of one of the side angle frame connectors 12 and then lowering the edge board down by pivoting it into the slots 19 of the remaining side angle frame connectors. When the edge boards are installed, the alignment of the arches should be checked with any adjustment being made to re-center the arch legs at the elevation of the side angle frame connectors. Then the edge boards can be secured to the side angle frame connectors by use of the bottom tab nail/screw holes 12*l*. To complete assembly of the framing structure, the ridge board 26 would be installed in the ridge angle frame connector slots 19 in the same manner as the edge boards were installed and secured to the angle frame connectors through the bottom tab nail/screw holes 12*l*. Prior to fastening the ridge board to its angle frame connectors, the alignment of the arches could be check and any necessary adjustment could be made at the elevation of the ridge angle frame connectors.

Because framing grade nominal 2×4 lumber may be bowed or warped, the ability of this framing system to adjust the alignment of the arches at both the elevation of the side angle frame connectors and the elevation of the ridge frame connectors can be very helpful in establishing a squared-up framework. Even through the arch legs 22, 24 are vertically fastened to the base frame connectors at four foot on centers, this alone will not ensure that the side angle frame connectors and ridge angle frame connectors will be automatically aligned at four foot on centers.

It is to be noted that the edge and ridge boards 28, 30 and 26 are not required for structural integrity of the arches 10. The edge and ridge boards serve to tie the arches into a unitary frame structure and also serve as fastening members for the roofing material that will be added to complete an enclosed structure.

The frame system, in a very simple configuration, could be assembled in four foot modules so that base frame connectors 16 would be secured to the base frame on four foot centers. This simplified configuration could be suitable for storage sheds and the like. Thus, if the structure were 12 feet in length, there might be four arches 10 provided; one arch at each end and two arches located at ⅓ intervals inward from the end arches, so that there would be provided an arch 10 at four foot intervals from one end of the structure to the other. Each board 26, 28, 30 would be twelve feet in length and secured to each of the four arches. For a structure eight feet in length, three arches would be provided and the ridge and edge boards would be eight feet in length. For a structure sixteen feet in length, five arches would be provided and the ridge and edge boards would be sixteen feet in length. For a structure six feet wide, the rib boards would be about thirty-six inches in length. For a structure eight feet wide, the rib boards would be about fifty inches in length. For a structure ten feet wide, the rib boards would be about sixty-four inches in length. A simplified frame provided by this framing system may be covered with plastic or canvas sheet material to provide an inexpensive roof and wall. It may also be covered with four foot wide panels of plywood, both roof and side walls, since the arches are preferably located four foot on centers. Then the roof, at least, could be further covered with waterproof roofing material. The following tables illustrates how a simplified structure could be specified and provided as a kit or simply provided as a set of instructions for assembling the necessary materials. In the preferred configuration of the angle frame connectors that provide a 120° angle between adjacent lumber segments, a single angle frame connector size suffices.

In FIGS. 12-14, a more complicated configuration employing the framing system of this invention is illustrated. In this configuration, the assembled arches 10 are located on two foot centers, as would be the case in conventional construction. The front arch, illustrated in FIG.

13, would be configured as heretofore described and, additionally, would be provided with a pair of door jambs 23, 25 that would be secured to the base 14 by means of base frame connectors 16' and to the rafters 18, 20 by means of base frame connectors 16'''; and would be provided with a door header 35 that would be secured to the door jambs 23, 25 by means of base frame connectors 16''. As in conventional construction, the rafter assemblies may be braced by cross-ties 33 appropriately secured to the rafters 28, 20. During the installation process, the individual arches may be temporarily held in position by temporary bracing 39 until the edge/ridge boards were installed and fastened to the arches. Appropriate siding, such as 4'×8' plywood sheathing 70 could be attached to the exterior, and appropriate roofing material 72 could be attached to the rafters.

To assist in the assembly of identical arch configurations, the technique illustrated in FIG. 12 could be employed. In this technique, an arch would be assembled with the angle frame connectors on one side of the arch members; then that arch would be turned over and short segments of lumber (normally nominal 2×4 inch lumber) would be inserted in the angle frame connector slots 19 to help align the opposing-side angle frame connectors. Then the opposing-side angle frame connectors would be attached to the other side of the arch members. This fully assembled arch would then become the pattern or template for the assembly of the remaining arches. Leaving the short lumber segments 60, 62 and 64 in place as shown in FIG. 12, the remaining arches would be assembled over the previously-assembled arches; FIG. 12 illustrating three such arches stacked one on top of the other. By using this technique, the builder insures that each of the arch legs 22', 24' and each of the rafter segments 18', 20' and each of the angle frame connectors 12' are aligned so that the arches are identical to one another after the assembly process is completed. By requiring the assembly process to involve the short lumber segments, 60, 62 and 64, it is assured that the angle frame connectors 12' will be aligned properly so that the edge and ridge boards, 28, 30 and 28 for insertion into the angle frame connectors slots 19.

The following Tables of Structure Specifications illustrate some typical examples for construction of various kinds of buildings.

Tables of Structure Specifications

TABLE 1

| Material List for 6' × 8' structure (Three Arch Sets, 4' on centers) |
|---|
| Base Materials |
| 2 - 2" × 4" × 65" Kiln dried lumber |
| 2 - 2" × 4" × 72" Kiln dried lumber |
| 2 - 2" × 4" × 83" Kiln dried lumber |
| 2 - 2" × 4" × 96" Kiln dried lumber |
| Arch Sets - (Three Each on Four Foot Centers) |
| 3 - 2" × 4" × 96" Kiln dried lumber Ridge/Edge Boards |
| 6 - 2" × 4" × 361/2" Kiln dried lumber Roof Rib Boards |
| 6 - 2" × 4" × 60" Kiln dried lumber Leg Boards |
| 9 - Angle Frame Connectors |
| 6 - Base Frame Connectors |
| Door Frame |
| 2-2" × 4" × 96" Vertical Boards |
| 2-2" × 4" × 72" Cross Boards |

TABLE 1-continued

| Material List for 6' × 8' structure (Three Arch Sets, 4' on centers) |
|---|
| Miscellaneous |
| 2" nails and multi-purpose screws |
| Sheathing and Roofing Materials |

TABLE II

| Material List for 8' × 14' structure (Eight Arch Sets, 2' on centers) |
|---|
| Base Materials |
| 2 - 2" × 4" × 14' Kiln dried lumber |
| 2 - 2" × 4" × 7'4" Kiln dried lumber |
| 2 - 2" × 4" × 13'5" Pressure-treated lumber |
| 2 - 2" × 4" × 7'11" Pressure-treated lumber |
| Arch Sets - (Eight Each on Four Foot Centers) |
| 3 - 2" × 4" × 14' Kiln dried lumber Ridge/Edge Boards |
| 16 - 2" × 4" × 4'11/8" Kiln dried lumber Roof Rib (Rafter) Boards |
| 16 - 2" × 4" × 7'61/4" Kiln dried lumber Leg (Stud) Boards |
| 8 - 2" × 4" × 6' Kiln dried lumber cross ties |
| 48 - Angle Frame Connectors |
| 16 - Base Frame Connectors |
| Door Frame/Back Wall |
| 2 - 2" × 4" × 8'61/4 Vertical Boards (Door Jambs) |
| 1 - 2" × 4" × 4' Cross Board (Door Header) |
| 2 - 2" × 4" × 120" Vertical Boards for Back Wall Frame |
| 10 - Base Frame Connectors |
| Miscellaneous |
| 6 - 1" × 4" × 8' Bracing Boards |
| 16 Sheets of 4' × 8' Sheathing Material |
| 2#16d Nails |
| 3#1'1/4" Deck Screws |
| 150 Sq. Ft. Roofing Material |

While the preferred embodiment of the invention has been described herein, variations in the design may be made.

The angle frame connectors could be fabricated, for example, with tabs 12*c*, 12*d* and 12*e* bent outward, rather than inward as shown. Orienting these tabs, 12*c, d* and *e*, outward at a right angle extending from the angle frame connectors outer surface 15, (or orienting them inward at a right angle extending from the inner surface 17 as seen in FIGS. 6-7), is a matter of choice. Some suppliers might prefer one version over the other, and both are within the scope of this invention. Also, tabs 12*c, d* and *e* could be oriented so that tabs 12*c-d* extended inward and tab 12*e* extended outward, or vice versa, again depending on one's preference. Also, instead of a tab that is bent as described above, a separate piece of the material can be coupled to the connector 12, such as by gluing, welding, fastening or otherwise coupling the strip of material to the connector 12.

The various features associate with the examples described herein and shown in the accompanying drawings can be implemented in different examples and implementations without departing from the scope of the present disclosure. Therefore, although certain specific constructions and arrangements have been described and shown in the accompanying drawings, such embodiments are merely illustrative and not restrictive of the scope of the disclosure, since various other additions and modifications to, and deletions from, the described embodiments will be apparent to one of ordinary skill in the art.

What is claimed is:

1. A device consisting of:

an angle frame connector with two halves each having an outer face and an inner face and a top with a center and a bottom and a rectangular slot in the center of the top with three sides and an open top, a plurality of connector tabs that extend out from the inner face where two tabs are on the top and three tabs on each side of the slot where the connector has a lip that extends perpendicularly from a bottom of the inner face, the lip has lip tabs that extend out longer than the bottom of the connector where the lip tabs are angled downward and the lip has a single, continuous protruding bead extending between the lip tabs, where the outer face of the connector has a plurality of protrusions protruding therefrom where the protrusions each have a center straight section that extends between the two halves of the connector and an upturned section at a distal end of each straight section that extends transversely across the two halves of the connector, where the lip tabs, each connector tab and the faces of the connector have holes punched therein.

2. The device according to claim 1 wherein the angle frame connector is made out of sheet metal.

3. A framing system comprising:

the device according to claim 1;

a plurality of lumber segments with two ends; and wherein the angle frame connectors are fastened to the lumber segments with each inner face facing each other where the tabs overlay and contact narrow edges of the lumber segments and the lips are fastened to the lumber segments.

4. The framing system according to claim 3 further comprising: a lumber cross segment which sets into the slot and is fastened to the tab that extends from the slot.

* * * * *